US008867978B2

(12) United States Patent
Fujita et al.

(10) Patent No.: US 8,867,978 B2
(45) Date of Patent: Oct. 21, 2014

(54) IMAGE FORMING METHOD AND IMAGE FORMING APPARATUS

(75) Inventors: Michiyo Fujita, Tokyo (JP); Tatsuya Nagase, Tokyo (JP); Asao Matsushima, Tokyo (JP); Yasuko Uchino, Tokyo (JP); Aya Shirai, Tokyo (JP); Ryuichi Hiramoto, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 112 days.

(21) Appl. No.: 13/338,917

(22) Filed: Dec. 28, 2011

(65) Prior Publication Data

US 2012/0177426 A1 Jul. 12, 2012

(30) Foreign Application Priority Data

Jan. 12, 2011 (JP) ..... 2011-003647

(51) Int. Cl.
*G03G 15/20* (2006.01)
*G03G 15/00* (2006.01)

(52) U.S. Cl.
CPC .... *G03G 15/6585* (2013.01); *G03G 2215/0081* (2013.01)
USPC ..... 399/341; 399/342

(58) Field of Classification Search
CPC ..... G03G 2215/00805; G03G 2215/0081; G03G 2215/00801; G03G 15/6582; G03G 15/6585; G03G 8/00
USPC ..... 399/341, 342
See application file for complete search history.

(56) References Cited

U.S. PATENT DOCUMENTS

| | | | | |
|---|---|---|---|---|
| 5,583,660 | A * | 12/1996 | Rylander | 358/3.17 |
| 6,535,712 | B2 * | 3/2003 | Richards | 399/341 |
| 7,340,190 | B2 * | 3/2008 | Toyohara et al. | 399/45 |
| 7,890,034 | B2 * | 2/2011 | Murayama et al. | 399/299 |
| 7,952,752 | B2 * | 5/2011 | Shoji | 358/1.9 |
| 8,383,189 | B2 * | 2/2013 | Lang | 427/8 |
| 8,447,204 | B2 * | 5/2013 | Qiao et al. | 399/82 |

FOREIGN PATENT DOCUMENTS

| | | | |
|---|---|---|---|
| JP | 05-232840 | | 9/1993 |
| JP | 06-273994 | | 9/1994 |
| JP | 11-007174 | | 1/1999 |
| JP | 2007108585 | A * | 4/2007 |

* cited by examiner

*Primary Examiner* — David Gray
*Assistant Examiner* — Carla Therrien
(74) *Attorney, Agent, or Firm* — Lucas & Mercanti, LLP

(57) ABSTRACT

A method of forming an image comprising the steps of: forming an image on an image support to obtain an original image, and forming a gloss adjusting layer comprising a clear toner-fixed image comprising a clear toner on the original image, wherein the gloss adjusting layer comprises an aggregate of gloss adjusting units, wherein the gloss adjusting units each comprise a section where the clear toner is attached and a section where the clear toner is unattached, wherein a borderline between the section where the clear toner is attached and the section where the clear toner is unattached comprises a straight line.

6 Claims, 3 Drawing Sheets

IMAGE FORMING METHOD AND IMAGE FORMING APPARATUS

This application claims priority from Japanese Patent Application No. 2011-003647 filed on Jan. 12, 2011, which is incorporated hereinto by reference.

TECHNICAL FIELD

The present invention relates to an image forming method and an image forming apparatus.

BACKGROUND OF THE INVENTION

In recent years, in order to improve an added value in the field of printing such as catalog printing, direct mail printing and so forth, there has been an increasing demand for high value-added prints having been subjected to a surface treatment such as a gloss treatment, for example. With respect to such a print, demanded have been those of which gloss of an entire or a part of the surface can be adjusted to a desired glossiness, and further demanded have been those of which gloss can be precisely controlled.

In Patent Document 1, as a technique to form a gloss surface uniformly on the entire surface, proposed has been a method to use, for example, a toner containing no colorant, which is called as a clear toner or a transparent toner. More concretely, proposed has been a method to form a gloss surface uniformly on the entire surface of a print, by providing a clear toner layer on an image formed via, for example, inkjet printing, followed by heating and then cooling.

However, in the method proposed in Patent Document 1, it has been difficult to form an image in which an arbitrary section is adjusted to an arbitrary glossiness, while an image of which glossiness of entire print surface is improved has been formed.

Patent Document 1: Japanese Patent Application Publication Open to Public Inspection (hereafter referred to as JP-A) No. 11-7174.

SUMMARY OF THE INVENTION

In view of the foregoing problems, the present invention was achieved. An object of the present invention to provide an image forming method capable of forming an image for which an arbitrary section is adjusted to arbitrary glossiness, and to provide an image forming apparatus thereof.

One of the aspects to achieve the above object of the present invention is a method of forming an image comprising the steps of: forming an image on an image support to obtain an original image; and forming a gloss adjusting layer comprising a clear toner-fixed image comprising a clear toner on the original image, wherein the gloss adjusting layer comprises an aggregate of gloss adjusting units, wherein the gloss adjusting units each comprise a section where the clear toner is attached and a section where the clear toner is unattached, wherein a borderline between the section where the clear toner is attached and the section where the clear toner is unattached comprises a straight line.

BRIEF DESCRIPTION OF THE DRAWINGS

Embodiments will now be described, by way of example only, with reference to the accompanying drawings which are meant to be exemplary, not limiting, and wherein like elements numbered alike in several figures, in which:

FIGS. 1*a* and 1*b* each show a schematic diagram to explain an image forming method of the present invention, wherein FIG. 1*a* is a diagram showing a state where an original image is formed on an image support, and FIG. 1*b* is a diagram showing a state where a gloss adjusting layer is formed on the original image;

DESCRIPTION OF THE PREFERRED EMBODIMENTS

Figure 1A:
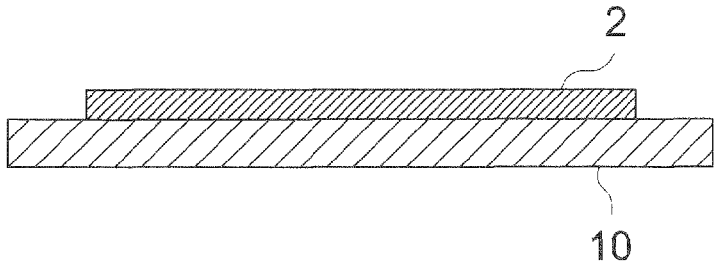

The above object of the present invention is achieved by the following structures.

(1) A method of forming an image comprising the steps of forming an image on an image support to obtain an original image, and forming a gloss adjusting layer comprising a clear toner-fixed image comprising a clear toner on the original image, wherein the gloss adjusting layer comprises an aggregate of gloss adjusting units, wherein the gloss adjusting units each comprise a section where the clear toner is attached and a section where the clear toner is unattached, wherein a borderline between the section where the clear toner is attached and the section where the clear toner is unattached comprises a straight line.

(2) The method of Item (I), wherein the gloss adjusting layer has a thickness of 3-20 μm.

(3) The method of Item (1) or (2), wherein the clear toner comprises a particle having a particle diameter of 5-15 μm.

(4) The method of any one of Items (1) to (3), wherein the gloss adjusting units each has a form of a square, wherein one side of the square is 100-500 μm.

(5) The method of Item (4), wherein the gloss adjusting units each are composed of four squares, each of the four squares being formed by dividing each of the gloss adjusting units vertically and horizontally in half, wherein the four squares are arrange to form a checkered pattern in which two of the four squares are the sections where the clear toner is attached, wherein the sections where the clear toner is attached are diagonally arranged.

(6) An image forming apparatus comprising:

a device for forming a clear toner image by which an electrostatic latent image formed on an electrostatic latent image carrier is developed with a developer containing a clear toner to form the clear toner image, and a device for forming a gloss adjusting layer by which the clear toner image is transferred onto an original image and fixed to form the gloss adjusting layer, the original image being obtained by forming an image on an image support, wherein the gloss adjusting layer comprises an aggregate of gloss adjusting units, wherein the gloss adjusting units each comprise a section where the clear toner is attached and a section where the clear toner is unattached, wherein a borderline between the section where the clear toner is attached and the section where the clear toner is unattached comprises a straight line.

According to the method of forming an image of the present invention, an image in which an arbitrary section is adjusted to arbitrary glossiness can be formed by using a gloss adjusting unit of selected kind and size, since a gloss adjusting layer containing a clear toner-fixed image formed on an image support is formed from an aggregate of gloss adjusting units, the gloss adjusting units each contain a section to which a clear toner is adhered (hereinafter, also referred to as "a section where a clear toner is attached") and a section to which no clear toner is adhered (hereinafter, also referred to as "a section where a clear toner is unattached"), and a borderline between the section where a clear toner is attached and the section where a dear toner is unattached is a straight line.

According to an image forming apparatus of the present invention, since an image forming method of the present invention is carried out, an image in which an arbitrary section is adjusted to arbitrary glossiness can be obtained.

The present invention will now be explained in detail.

[Image Forming Method]

In the present invention, an image of which gloss is adjusted (hereafter, also referred to as a gloss adjusted image) is obtained according to a method of image forming containing the steps of:

forming an image on an image support to obtain an original image, and forming a gloss adjusting layer containing a clear toner-fixed image containing a clear toner on the original image.

Therefore, according to the image fanning method of the present invention, the gloss of all or a part of the formed image can be adjusted to have a desired gloss.

In the present invention, an original image refers to an image before being substituted to adjustment of the gloss at an arbitrary gloss on an arbitrary portion, the original image being a colorless or colored image formed regardless of a image forming method.

In the method of image forming of the present invention, an image forming apparatus by which an original image forming step to form an original image and a gloss adjusting layer forming step are continuously carried out may be use, or, alternatively, the original image forming step and the gloss adjusting layer forming step may be carried out using individual image forming apparatuses.

[Step of Forming Original Image]

In the step of forming an original image, the method of forming an original image is not specifically limited, and any image forming methods well known in the art are applicable. Examples of an original image forming method include image forming methods such as an electrophotographic image forming method, an inkjet method and a printing method. Of these methods, an electrophotographic image forming method is specifically preferably used in relation to the clear toner forming the gloss adjusting layer. Also, an original image is preferably a color image.

An example to form an original image via an electrophotographic method will be concretely explained below. As shown in FIG. 1*a*, a toner image formed by developing an electrostatic latent image on an electrostatic latent image carrier with a tone is transferred on image support 10, followed by heating • pressing the transferred toner image for fixing Thus, original image 2 is obtained.

Original image 2 may be formed by using a plurality of color toners such as a yellow toner, a magenta toner, a cyan toner and a black toner, or may be formed with a single color toner. Further, it may be formed with a colorless toner.

[Step of Forming Gloss Adjusting Layer]

Figure 1B:
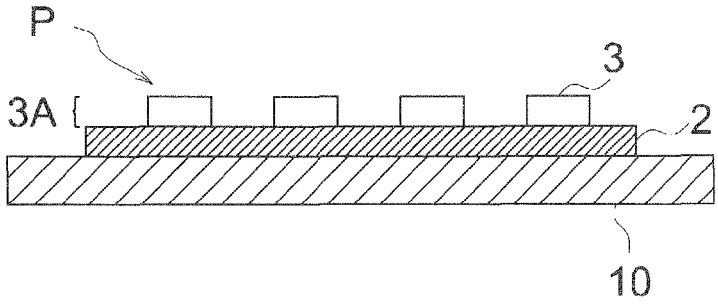

In the step of forming a gloss adjusting layer, an image forming method of an electrophotographic method may be adopted as a method of forming a gloss adjusting layer. For example, as shown in FIG. 1*b*, a clear toner image formed by developing an electrostatic latent image having been formed on an electrostatic latent image carrier with a clear toner is transferred onto original image 2, and clear toner-fixed image 3 is formed by heating and pressing the clear toner image having been transferred for fixing, whereby gloss adjusting layer 3A is formed.

In an image forming method of the present invention, gloss adjusted image P in which gloss adjusting layer 3A is formed on an original image 2 is formed by conducting the step of forming a gloss adjusting layer, namely, the gloss of gloss adjusted image P is adjusted by the appropriated formation of gloss adjusting layer 3A. On the surface of the resulting gloss adjusted image P, a ratio of diffuse reflection light and specular reflection light on the surface of gloss adjusted image P is varied depending on the concavo-convex degree produced by the presence or absence of clear toner-attached sections constituting gloss adjusting layer 3A, whereby glossiness is also varied. Accordingly, the glossiness can be controlled by appropriately selecting the concavo-convex degree caused by presence or absence of the clear toner-attached sections constituting gloss adjusting layer 3A, that is, for example, the kind, size, a placing method thereof of the later mentioned gloss adjusting unit, whereby gloss adjusted image P in which arbitrary section is adjusted to have any glossiness can be obtained.

In the method of image forming of the present invention, in the step when a clear toner layer formed on an electrostatic latent image carrier is transferred and fixed on the original image 2 to form a gloss adjusted layer P, the clear toner is prevented from being buried in the original image since the gloss adjusting layer 3A is formed on original image 2 which has been already fixed. Accordingly, on the surface of gloss adjusted image P, the concavo-convex caused by the presence or absence of the clear toner-attached section can be successfully formed. Therefore, desired glossiness can be obtained with a high degree of precision in gloss adjusted image P.

In the step of forming a gloss adjusting layer, gloss adjusting layer 3A to be formed is formed from an aggregate of gloss adjusting units, that is an aggregate where the gloss adjusting units are repeated, and planarly placed, and, the gloss adjusting units each are composed of one in which a borderline between the clear toner-attached section and the clear toner-unattached section is a straight line. Gloss adjusting layer 3A has a function to adjust the glossiness by employing a gloss adjusting unit of a selected kind and size, whereby an arbitrary section can be adjusted to an arbitrary glossiness in gloss adjusted image P.

As to the layer thickness of gloss adjusting layer 3A, specifically, the clear toner-attached section preferably has a thickness of3-20 μm, and more preferably has a thickness of 4-13 μm. When the layer thickness of gloss adjusting layer 3A falls within the above-des bed range, arbitrary sections can be surely adjusted to any glossiness. When the layer thickness of gloss adjusting layer 3A is too small, no excellent reproducibility for gloss adjusting layer 3A is produced since a clear toner adhesion amount is insufficiently obtained, and in gloss adjusted image P, arbitrary sections tend not to be adjusted to any glossiness. On the other hand, when the layer thickness of gloss adjusting layer 3A is too large, the fusion among clear toner particles may not be enough, whereby the transparency of the clear toner-attached section may be reduced resulting in spoiling the color of original image 2.

[Gloss Adjusting Unit]

In the present invention, a gloss adjusting unit, contains a clear toner-attached section and a clear toner-unattached section, and a borderline between the clear toner-attached section and the clear toner-unattached section is a straight line. Herein, what a borderline between the clear toner-attached section and the clear toner-unattached section is a straight line means that a writing state of a clear toner attached section is in the form of a straight line, and a very small curve contained in the straight line caused by a part of a writing dot or the shape of a toner particle is substantially regarded as a straight line. As an example of what a borderline between the clear toner-attached section and the clear toner-unattached section is a straight line, cited is one in which the clear toner-attached section in a region as the gloss adjusting unit is in the form of a polygon having straight line sides. On the other hand, the ease in which the border line between a gloss adjusting toner-attached section and the gloss adjusting toner-unattached section is in the form of a circle as disclosed in, for example, JP-A No. 5-232840 or 6-273994 is not included in the gloss adjusting unit of the present invention. In these Patent Documents, proposed has been a method of providing glossiness via image surface processing using a clear toner, however, since clear toner-attached section is in the form of a circle, the resulting image exhibits not fully sufficient preciseness in adjusting gloss of the gloss adjusting layer, and desired glossiness tends not to be obtained in these methods. When a gloss adjusting unit is circle-shaped, asperity of the gloss adjusting layer may be reduced since the gloss adjusting unit tends to be expanded during fixing, and control of glossiness tends to be less-precise. Further, since it is difficult to control the gloss adjusting unit in size when circularly writing, the gloss adjusting unit preferably contains straight lines.

The kind and the size of the gloss adjusting unit are appropriately selected depending on glossiness to be adjusted, however the gloss adjusting unit as a whole is preferably in the form of a regular polygon, and is more preferably in the form of a square.

A gloss adjusting unit in the form of a square is preferably a square of which length of one side is 100-500 μm. Assuming that the area of a portion of an original image of which gloss is to be adjusted is constant, in which gloss adjusting units are densely placed vertically and horizontally within the image plane, the longer the side of the gloss adjusting unit is, the higher the glossiness is, and the shorter the side of the gloss adjusting unit is, the lower the glossiness is. In this case, concave-convex portions caused by the presence or absence of attached clear toner in the resulting gloss adjusted image P are also reduced when the length of one side of a gloss adjusting unit becomes longer, that is, since the number of repeating gloss adjusting units is small, a diffuse reflection light rate is reduced, and a specular reflection light rate is increased, resulting in increase of glossiness. On the other hand, concave-convex portions caused by presence or absence of attached clear toner in the resulting gloss adjusted image P are also increased when the length of one side of a gloss adjusting unit becomes shorter, that is, the number of repeating gloss adjusting units is large, a diffuse reflection light rate is increased, and a specular reflection light rate is reduced, resulting in reduction of glossiness.

Figure 2A:
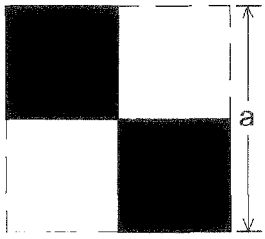
FIGS. 2*a*, 2*b*, 2*c* and 2*d* each are a diagram showing a specific example of a gloss adjusting unit used for an image forming method of the present invention.
Figure 2B:
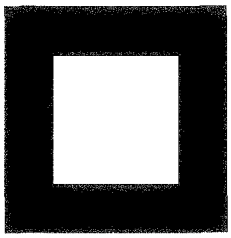
Figure 2C:
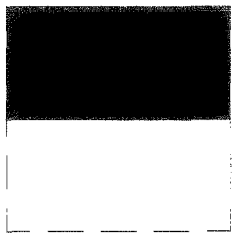
Figure 2D:
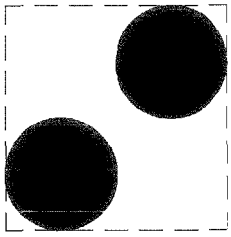

FIGS. 2*a*, 2*b* and 2*c* each show a specific example of a gloss adjusting unit in the form of a square. In FIGS. 2*a*, 2*b* and 2*c*, the black-smeared section shows a clear toner-attached section, and the white patch section shows a clear toner-unattached section. In FIG. 2*a*, a gloss adjusting unit is divided into four squares by vertically and horizontally dividing the gloss adjusting unit each in half, and two of the four squares are clear toner-attached sections while the other two are clear toner-unattached sections, in which no clear toner-attached sections are vertically or horizontally neighboring, namely, the two clear toner-attached sections are diagonally arranged in the gloss adjusting unit, whereby a checkered pattern is formed. In FIG. 2*b*, a gloss adjusting unit has a pattern in which a square frame-shaped section provided along four sides of a region in the form of a square is formed as a gloss adjusting toner-attached section. In FIG. 2*c*, a gloss adjusting unit has a pattern in which, among the two rectangles formed by horizontally dividing the gloss adjusting unit in half, the upper rectangle is a clear toner-attached section and the lower a clear toner-unattached section. Further, FIG. 2*d* shows a configuration in which two circular clear toner-attached sections each having a length of one-half of a side of the gloss adjusting unit as a diameter of the circle are formed, as shown in the figure.

As a gloss adjusting unit as a whole in the form of a square, the gloss adjusting unit shown in FIG. 2*a* is specifically preferable. It is assumed that the preciseness to adjust gloss depends on the total distance of a borderline between the clear toner-attached section and the clear toner-unattached section in the region of a gloss adjusting unit Accordingly, it is expected that the gloss adjusting unit shown in FIG. 2*a* can adjust gloss more precisely when compared with, for example, the gloss adjusting unit shown in FIG. 2*b*, or in FIG. 2*c*, since the total distance of the borderline between the clear toner-attached section and the clear toner-unattached section in a gloss adjusting unit is longer in the case of FIG. 2*a* than in either cases of FIGS. 2*b* and 2*c*.

Figure 3A:
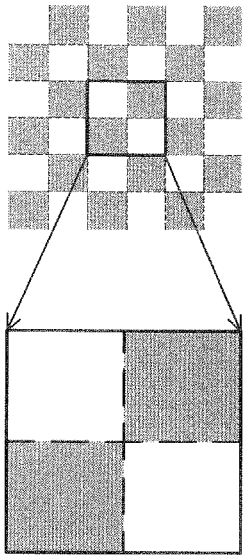
FIGS. 3*a*, 3*b*, 3*c* and 3*d* each are a diagram to explain the total distance of borderlines each between a clear toner-attached section and a clear toner-unattached section in a gloss adjusting unit used for an image forming method of the present invention.
Figure 3B:
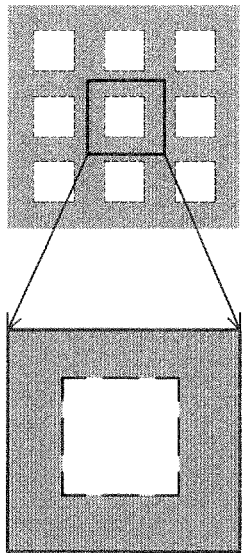
Figure 3C:
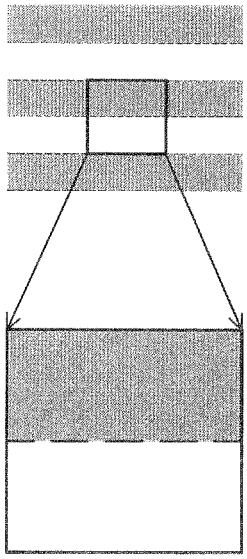
Figure 3D:
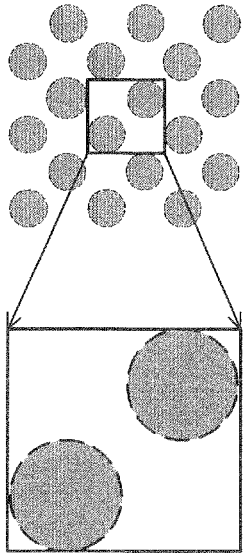

The total distance of the borderline between the clear toner-attached section and the clear toner-unattached section in the region of a gloss adjusting unit is preferably 100-400%, based on the perimeter of the entire shape of the gloss adjusting unit In addition, the total distance of the borderline between the clear toner-attached section and the clear toner-unattached section in the region of a gloss adjusting unit means that the total distance of the borderline between the clear toner-attached section and the clear toner-unattached section per a gloss adjusting unit when gloss adjusting units are repeated so as to densely placing them longitudinally and transversely, including the borderline between adjacent gloss adjusting units. Specifically, dashed lines in FIGS. 3*a*, 3*b* and 3*c* are borderlines each between the clear toner-attached section and the clear toner-unattached section. In FIG. 3*a*, when the perimeter of the entire shape of a gloss adjusting unit is expressed as A, the total distance of the borderlines becomes 200% with respect to A. Further, in FIG. 3*b*, when the perimeter of the entire shape of a gloss adjusting unit is expressed as A, the total distance of the borderlines becomes 100% with respect to A, and in FIG. 3*c*, when the perimeter of the entire shape of a gloss adjusting unit is expressed as A, the total distance of the borderlines becomes 100% with respect to A. Further, for reference, in FIG. 3*d*, the total distance of the borderlines becomes 157% with respect to A.

Glossiness in gloss adjusting layer 3A can also be controlled by a method of placing each of gloss adjusting units. As the method of placing gloss adjusting units, for example, it may be a method in which each of gloss adjusting units is densely placed vertically and horizontally, or a method in which gloss adjusting units each are placed in the predetermined intervals, however, the method in which each of gloss adjusting units is densely placed vertically and horizontally is preferable. Further, for example, when the gloss adjusting unit exhibits asymmetry of one above the other or right and left, it may also be a method in which each of gloss adjusting units is placed in accordance with a regular rule with respect to the direction of one above the other or right and left, or a method in which each of gloss adjusting units is placed at random. Further, for example, it may also be a method in which at least two gloss adjusting units used in combination are placed in accordance with a regular rule or at random.

Further, gloss adjusting layer 3A may be formed on the entire surface of i original image 2, or may be formed only locally on the surface of the original image.

[Clear Toner]

The clear toner used in the step of forming a gloss adjusting layer refers to a toner with which color is not visualized via action of light absorption or light scattering. That is, the clear toner may be substantially colorless and transparent, and specific examples thereof include a toner containing no colorant such a pigment, a dye or the like, a toner containing the foregoing colorant so as not to be recognized to have a color, and a toner exhibiting slightly low transparency caused by kinds and an addition amount of, for example, a binder resin, a releasing agent and external additives as components constituting the clear toner.

Clear toner particles constituting a clear toner contain, specifically, a binder resin exhibiting transparency, and, if necessary, may also contain, for example, a releasing agent and a charge control agent.

Examples of the transparent resin contained in clear toner particles include commonly known various thermoplastic resins such as vinyl based resins, for example, styrene based resins, (meth)acrylic resins, syrene(meth)acrylic copolymer resins, an olefin based resins and so forth; polyester based resins; polyamide based resins; polycarbonate resins; polyether, polyvinyl chloride based resins; polysulfone resins; polycarbonate resins and so forth; and thermosetting resins, for example, epoxy based resins. Specifically, in order to improve transparency, preferably provided are styrene based resins, acrylic resins and polyester based resins exhibiting high transparency together with a high sharp-melt property at low viscosity as to the melt property. These can be used singly or in combination with at least two kinds thereof.

As a releasing agent, contained in clear toner particles, commonly known wax is usable. Examples of the wax include polyolefin wax such as polyethylene wax, polypropylene wax and so forth; branched-chain hydrocarbon wax such as microcrystalline wax and so forth; long chain hydrocarbon wax such as paraffin wax, sazol wax and so forth; dialkyl ketone based wax such as distearyl ketone and so forth; ester based wax such as carnauba wax, montan wax, behenyl behenate, trimethylol propane trinbehenate, pentaeritbritol tetrabehenate, pentaerithritol diacetate dibehenate, glycerine tribehenate, 1,18-octadecane diol distearate, tristearyl trimellitate, distearyl maleate and so forth; and amide based wax such as ethylene diamine behenylamide, tristearylamide trimellitate and so forth.

The content of a releasing agent is preferably 1-15 parts by weight, based on 100 parts by weight of the binder resin, in view of the releasing property or transparency.

A charge control agent contained in clear toner particles is not specifically limited as long as it is a material capable of providing positive or negative charge via frictional electrification, and commonly known various positive charge control agents and negative charge control agents are usable, but those which are colorless and transparent are preferable.

The clear toner preferably has a softening point temperature of 85-140° C. in view of fixability of gloss adjusting layer 3A and reproducibility of dots.

The softening point of the clear toner is determined as described below. A measuring sample (clear toner) of 1.1 g is first placed in a Petri dish at a temperature of 20° C. and at a relative humidity of 50%, flattened out, and allowed to stand for at least 12 hours. Thereafter, a 1 cm diameter cylindrical molded sample is prepared via application of a pressure of 3,820 kg/cm$^2$, employing a molding machine "SSP-10A" (produced by Shimadzu Corp.). Subsequently, the resulting sample was measured under a temperature of 24° C. and a relative humidity of 50%, employing a flow tester "CFT-500D" (produced by Shimadzu Corp.). The resulting sample is extruded from a cylindrical die hole (1 mm diameter×1 mm) employing a 1 cm diameter piston after 300 second pre-heating under conditions of an applied load of 196 N (20 kgf), an initial temperature of 60° C., and a temperature raising rate of 6° C./minute, and offset method temperature $T_{offset}$ which is determined based on the fusion temperature determination method according to the temperature raising method, which is set at an offset value of 5 mm, is designated as the softening point of the clear toner.

Clear toner preferably has a glass transition point Tg of 35-70° C. in view of fixability of glass adjusting layer 3A, reproducibility of dots and effect to original image 2.

Glass transition point Tg of a clear toner is measured with "Diamond DSC" manufactured by Perkin-Elmer Corp. In the measuring procedure, 3.0 mg of a measuring sample (clear toner) is enclosed in an aluminum pan, and then set onto a sample holder in a main body. Measurements for reference were performed employing an empty aluminum pan. Temperature control of Heat-Cool-Heat is carried out under the conditions of a measurement temperature of 0-200° C., a temperature-increasing speed of 10° C./min and a temperature-decreasing speed of 10°0 C./min, and analysis is made based on the data of the 2nd Heat. In addition, temperature was maintained at 200° C. for 5 minutes during temperature-increase of the first Heat. Glass transition point Tg is designated as the temperature at an intersection point of an extension line of a base line before rising of the first endoergic peak and the tangential line shown at the maximum inclination in the range between the rising part of the first endoergic peak and the peak thereof.

Clear toner particles constituting the clear toner preferably have a volume-based median diameter of 5-15 μm as the particle diameter, and preferably have a volume-based median diameter of 6-12 μm as the particle diameter. When the particle diameter of each of clear toner particles is within the above-described range, gloss adjusting layer 3A formed from an aggregate obtained by repeating gloss adjusting units exhibits excellent reproducibility, and arbitrary section can be surely adjusted to any glossiness in gloss adjusted image P. When the particle diameter of each of the clear toner particles is too small, no excellent developability is obtained, and a toner adhesion amount is insufficiently obtained, whereby gloss adjusting layer 3A formed from an aggregate obtained by repeating gloss adjusting units does not exhibit excellent reproducibility, and arbitrary section might not be adjusted to any glossiness. On the other hand, when the particle diameter of each of the clear toner particles is too large, gloss adjusting layer 3A tends not exhibit excellent reproducibility, whereby the color of original image 2 may be spoiled.

The volume-based median diameter of the clear toner particles is measured and calculated by using "Coulter Counter Multisizer 3" manufactured by Beckman Coulter Co., Ltd. and a computer system fitted with a software for data processing "Software V3.51", manufactured by Beckman Coulter Co., Ltd. As measuring procedures, 0.02 g of a measuring sample (clear toner) are wetted in 20 ml of a surfactant solution for dispersing the toner (for the purpose of dispersing the clear toner, for example, a surfactant solution prepared by diluting a neutral detergent with pure water by 10 times), and subsequently subjected to ultrasonic dispersion for one minute to prepare a measuring sample dispersion. The measuring sample dispersion is injected into a beaker set on a sample stand, in which Isoton II, manufactured by Beckman Coulter Co., Ltd., is contained, until the concentration indicated by the measuring device reaches 5-10%. Measured values in high reproducibility can be obtained by falling within this concentration range. The frequency is calculated by separating the range of 2.0-60 μm into 256 divisions under the conditions of the count number of measuring particles of 25,000 and an aperture diameter of 100 μm with the measuring device, and the particle diameter at a point of 50% from the larger side of the volume accumulation ratio is specified as the volume-based median diameter.

Clear toner particles constituting the clear toner preferably have an average circularity of 0.900-0.980 in view of reproducibility of dots. When the average circularity of clear toner particles falls within the above-described range, gloss adjusting layer 3A formed from an aggregate obtained by repeating adjusting units exhibits excellent reproducibility, and arbitrary section can be surely adjusted to any glossiness.

The average circularity of clear toner particles is measured by "FPIA-2100" (manufactured by Sysmex Corp.). Specifically, a measuring sample (clear toner) is wetted with an aqueous solution containing a surfactant, followed by conducting an ultrasonic dispersion treatment for one minute, and thereafter the dispersion of toner particles is photographed with "FPIA-2100" (manufactured by Sysmex Corp.) in an HPF (high magnification photographing) mode at an appropriate density of the HPF detection number of 3,000-10,000 as a measurement condition. The circularity of each toner particle is calculated in accordance with Equation (T) described below. Then, the average circularity is calculated by summing the circularities of each of particles and dividing the resulting value by the total number of particles.

Circularity=(circumference length of a circle having an area equivalent to a projection of a particle)/(circumference length of a projection of a particle) Equation (T):

As methods of manufacturing the clear toner, provided are a kneading-pulverizing method, a suspension polymerization method, an emulsion polymerization method, an emulsion polymerization coagulation method, a mini-emulsion polymerization coagulation method, and an encapsulation method, and commonly known other methods, but a method of manufacturing the clear toner is preferably an emulsion polymerization coagulation method in view of production cost and manufacturing stability.

In the emulsion polymerization coagulation method, a dispersion of transparent resin particles contained in clear toner prepared in the emulsion polymerization method is optionally mixed with a dispersion of particles made of a releasing agent or the like as a toner constituent component, if desired, and the dispersion is subjected to slow coagulation, which is carried out while balancing the repulsive force of particle surfaces by adjusting a pH and coagulating force generated via addition of coagulants composed of electrolytes, wherein association is carried out while controlling the average particle diameter and the particle size distribution, and at the same time heating and stirring is carried out to cause fusion among particles and control the particle shape. Thus, clear toner particles are prepared in the above-described method.

When the emulsion polymerization coagulation method is employed as a method to produce a clear toner, the resulting particles may be comprised of at least two layers containing binder resins differing in composition. In such a case, it is possible to employ a method in which polymerization initiators and polymerizable monomers are added to the first resin particle dispersion prepared by an emulsion polymerization treatment (the first stage polymerization) based on an ordinary method, and the resulting mixture is subjected to an additional polymerization treatment (the second stage polymerization).

Clear toner is usable as it is, in an image forming method of the present invention, but in order to improve fluidity, electrification, a cleaning property and so forth, the clear toner of the present invention may be obtained by adding external additives such as a fluidizing agent, a cleaning aid or the like as a post-processing agent into the clear toner particle.

As the post-processing agents, there are mentioned inorganic oxide particles such as silica particles, alumina particles and titanium oxide particles; inorganic stearic acid compound particles such as aluminum stearate particles and zinc stearate particles; and inorganic titanic acid compound particles such as strontium titanate particles and zinc titanate particles. These may be used singly or in combination with at least two kinds thereof. These inorganic particles are preferably surface treated with a silane coupling agent, a titanium coupling agent, a higher fatty acid or silicone oil in order to improve environmental stability or heat-resistant storage stability.

The clear toner used in an image forming method of the present invention is also usable as a magnetic or non-magnetic single component developer, but may also be employed as a double component developer after being mixed with carriers. When the clear toner used in the present invention is employed as a double component developer, magnetic particles are usable as the carrier, which are composed of commonly known materials such as metals, for example, iron, ferrite and magnetite, and an alloy made from the above-described metal and aluminum or lead. Of these, ferrite particles are specifically preferable. Further, employed as a carrier may be a coated carrier prepared by coating the surface of magnetic particles each with a coating agent such as a resin, and a binder type carrier prepared by dispersing magnetic powder in a binder resin. The coating resin constituting the coated carrier is not specifically limited, and examples thereof include olefin resins, styrene resins, styrene-acryl resins, silicone resins, polyesters and fluorine-containing resins. Further, resins each constituting a resin dispersion type carrier are not specifically limited, and the commonly known are specifically usable. Examples thereof include a styrene-acrylic resin, a polyester resin, a fluorine-containing resin and a phenol resin.

As the image support used in the image forming method of the present invention, provided can be various kinds of the image support, for example, plain paper from thin paper to heavy paper; fine-quality paper; coated paper for printing such as art paper or coated paper; commercially available Japanese paper and post-card paper; OHP plastic film; and fabric, but the present invention is not limited thereto.

In an image forming method of the present invention, gloss adjusting layer 3A for clear toner-fixed image 3 formed on original image 2 is formed from an aggregate of gloss adjusting units. When a gloss adjusting unit contains a clear toner-attached section and a clear toner-unattached section, an image in which an arbitrary section is adjusted to any glossiness can be fanned by using those in selected kind and size as gloss adjusting units.

[Image Forming Apparatus]

An image forming apparatus of the present invention possesses a device of forming a clear toner image by which an electrostatic latent image formed on an electrostatic latent image carrier is developed with a developer in which a clear toner is contained to form the clear toner image, and a device of forming a clear toner-fixed image by which the clear toner-fixed image is transferred onto an original image, and fixed to form the clear toner-fixed image, wherein the clear toner-fixed image formed by the device of forming the clear toner-fixed image comprises a gloss adjusting layer formed from an aggregate of gloss adjusting units; the gloss adjusting units each comprise a clear toner-attached section and a clear toner-unattached section; and a borderline between the clear toner-attached section and the clear toner-unattached section is a straight line.

Figure 4:
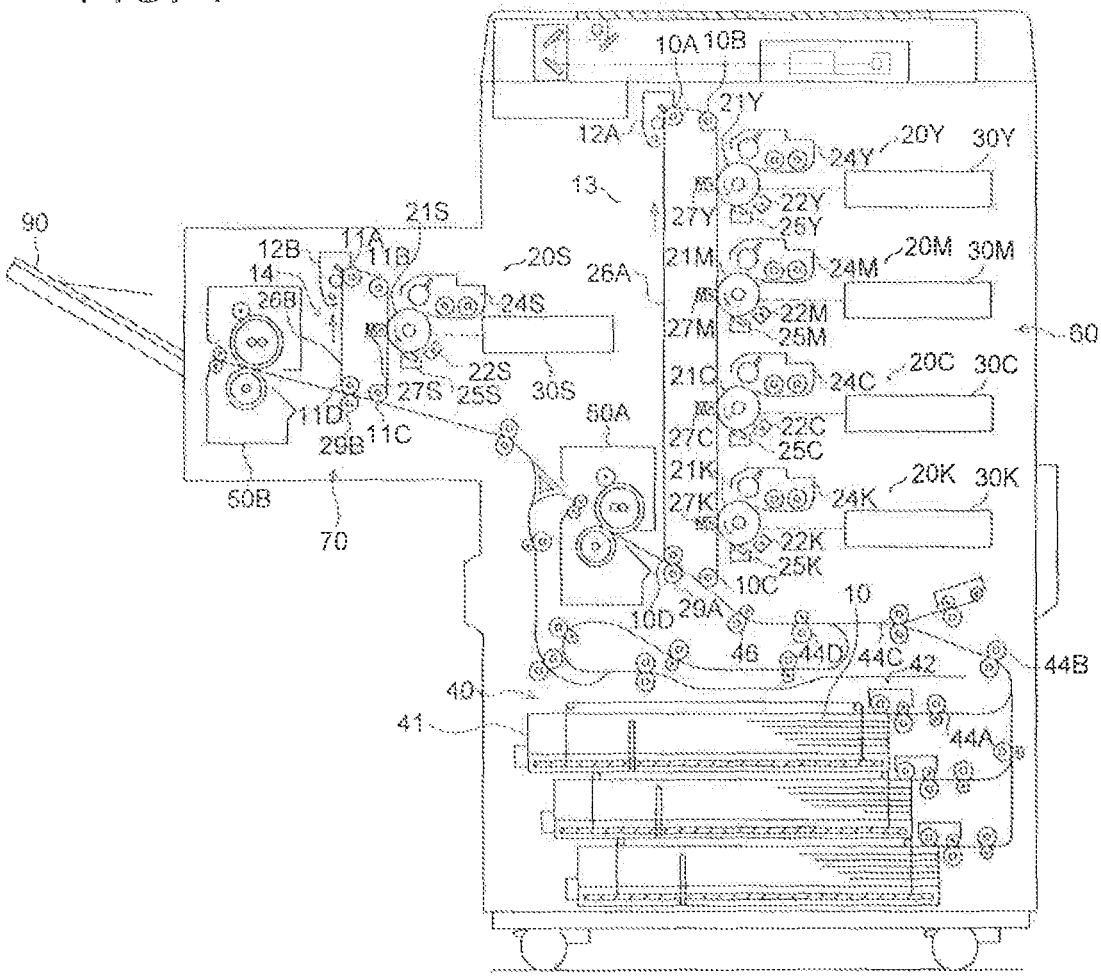
FIG. 4 is a schematic diagram showing an example of configuration of an image forming apparatus of the present invention.

FIG. 4 is a schematic diagram showing an example of configuration of an image forming apparatus of the present invention. The image fanning apparatus is a tandem type color image forming apparatus by which a step of forming a original image employing a chromatic toner and a step of forming a gloss adjusting layer with a clear toner are continuously operated in an image forming method of the present invention.

The image forming apparatus possesses original image forming section 60 equipped with a plurality of chromatic toner image forming sections 20Y, 20M, 20C and 20K, chromatic toner intermediate transfer unit 13 and fixing device 50A; and clear toner-fixed image forming section 70 equipped with clear toner image forming section 20S, clear toner intermediate transfer unit 14 and fixing device 50B; and sheet-feeding device 40.

In original image forming section 60, yellow toner images are formed in yellow toner image forming section 20Y; magenta toner images are formed in magenta toner image forming section 20M; cyan toner images are formed in cyan toner image forming section 20C; and black toner images are formed in black toner image forming section 20K.

In clear toner image forming section 20S in clear toner-fixed image forming section, a clear toner image which constitutes a gloss adjusting layer is formed.

In FIG. 4, each of 21Y, 21M, 21C and 21K represents a photoreceptor as an electrostatic latent image carrier; each of 22Y, 22M, 22C and 22K represents a charging device by which uniform potential is applied to the surface of each of photoreceptors 21Y, 21M, 21C and 21K; each of 30Y, 30M, 30C and 30K represents a light exposure device by which light exposure is conducted on each of evenly charged photoreceptors 21Y, 21M, 21C and 21K in accordance with image data to form an electrostatic latent image; each of 24Y, 24M, 24C and 24K represents a developing device by which the electrostatic latent image is visualized after transferring chromatic toner onto each of photoreceptors 21Y, 21M, 21C and 21K; each of 27Y, 27M, 27C and 27K represents a primary transfer roller as a primary transfer device; 26A represents an intermediate transfer member, 29A represents a secondary transfer roller as a secondary transfer device by which a chromatic toner image having been transferred onto intermediate transfer member 26A by each of primary transfer rollers 27Y, 27M, 27C and 27K is transferred onto image support 10; and each of 25Y, 25M, 25C and 25K represents a cleaning device by which residual toner remaining on each of photoreceptors 21Y, 21M, 21C and 21K is collected after primarily transferring.

Further, 21S represents a photoreceptor as an electrostatic latent image carrier; 22S represents a charging device by which uniform potential is applied to the surface of photoreceptor 21S; 30S represents a light exposure device by which light exposure is conducted based on data of an aggregate of gloss adjusting units in kind, size and a placing method selected in accordance with glossiness designed to be set on evenly charged photoreceptor 21S to form an electrostatic latent image; 24S represents a developing device by which the electrostatic latent image is visualized after transferring toner onto photoreceptor 21S; 27S represents a primary transfer roller as a primary transfer device; 26B represents an intermediate transfer member; 29B represents a secondary transfer roller as a secondary transfer device by which a clear toner image having been transferred onto intermediate transfer member 26B with primary transfer roller 27S is transferred onto an original image formed by original image forming section 60; and 25S represents a cleaning device by which residual toner remaining on photoreceptor 21S is collected after primarily transferring.

Chromatic toner intermediate transfer unit 13 in original image forming section 60 is windingly wound with a plurality of rollers 10A, 10B, 10C and 10D, and is equipped with rotatably supported endless belt-shaped intermediate transfer member 26A, primary transfer roller 27Y, 27M, 27C and 27K and cleaning device 12A. Similarly, clear toner intermediate transfer unit 14 in clear toner-fixed image forming section 70 is windingly wound with a plurality of rollers 11A, 11B, 11C and 11D, and is equipped with rotatably supported endless belt-shaped intermediate transfer member 26B, primary transfer roller 27S, and cleaning device 12B.

In such an image forming apparatus, chromatic toner images are formed on photoreceptors 21Y, 21M, 21C and 21K via electrification with charging devices 22Y, 22M, 22C and 22K, light exposure with light exposure devices 30Y, 30M, 30C and 30K and development with developing devices 24Y, 24M, 24C and 24K in chromatic toner image forming sections 20Y, 20M, 20C and 20K in original image forming section 60, followed by being transferred onto intermediate transfer member 26A by being sequentially juxtaposed using primary transfer rollers 27Y, 27M, 27C and 27K. Then, an image support 10 in a paper feed cassette 41, is fed by paper feed and a conveyance means 42 and conveyed to a secondary transfer roller 29A through plural feed rollers 44A, 44B, 44C and 44D and a resist roller 46, and the chromatic toner image transferred on intermediate transfer member 26A is secondarily transferred onto image support 10. The chromatic toner image transferred onto image support 10 is fixed in fixing device 50A via pressing while heating, whereby original image 2 is formed.

Subsequently, a clear toner image is formed on photoreceptor 21S via electrification with charging device 22S, light exposure with light exposure device 30S and development with developing device 24S in clear toner image forming section 20S in clear toner-fixed image forming section 70, and the clear toner image is transferred onto intermediate transfer member 26B with primary transfer roller 27S. The clear toner image transferred on the intermediate transfer member 26B is transferred onto original image 2 formed in original image forming section 60. Then, the clear toner image having been transferred onto original image 2 is fixed via application of pressure while heating in fixing device 50B to form clear toner-fixed image 3. Finally, image support 10 on which a clear toner-fixed image 3 is formed on an original image is placed on exhaust tray 90 outside of the apparatus.

Photoreceptors 21Y, 21M, 21C and 21K after transferring the chromatic toner image onto intermediate transfer member 26A are subjected to the subsequent image formation after cleaning toner remaining on each of the photoreceptors during transfer, employing each of cleaning devices 25Y, 25M, 25C and 25K. Further, photoreceptor 21S after transferring a clear toner image onto intermediate transfer member 26B is subjected to the subsequent image formation after cleaning toner remaining on the photoreceptor during transfer, employing cleaning device 25S. On the other hand, in the case of intermediate transfer member 26A after transferring the chromatic toner image onto image support 10, residual toner is removed therefrom by cleaning device 12A. Further, in the case of intermediate transfer member 26B after transferring the clear toner image onto the original image with secondary transfer roller 29B, residual toner is unloved therefrom by cleaning device 12B.

In the case of an image forming apparatus of the present invention, an image forming method of the present invention is carried out, whereby an image in which arbitrary section is adjusted to arbitrary glossiness can be formed.

EXAMPLES

Next, specific examples of the present invention will be described, however, the present invention is not limited thereto.

[Preparation Example 1 of Resin Particles Dispersion Liquid]

(1) The First Stage Polymerization

A surfactant solution obtained by dissolving 4 g of polyoxyethylene-2-dodecyl ether sodium sulfate in 3000 g of deionized water was charged in a 5 liter reaction vessel equipped with a stirrer, a temperature sensor, a cooling tube and a nitrogen gas introducing device, and internal temperature was raised to 80° C. while stirring at a stirring speed of 230 rpm under a nitrogen gas flow. After an initiator solution in which 5 g of a polymerization initiator (potassium persulfate: KPS) were dissolved in 200 g of deionized water was added into the above-described surfactant solution, and the liquid temperature was set to 75° C., a monomer mixture solution containing

| | |
|---|---|
| Styrene | 567 g |
| n-butylacrylate | 165 g |
| Methacrylic acid | 68 g |

was dripped over one hour, and the system was heated at 75° C. while stirring for 2 hours to conduct polymerization (the first stage polymerization) reaction, whereby dispersion <A1> in which resin particle [A1] was dispersed was obtained.

(2) The Second Stage Polymerization

A surfactant solution obtained by dissolving 2 g of polyoxyethylene-2-dodecyl ether sodium sulfate in 1270 g of deionized water was charged in a 6 liter reaction vessel equipped with a stirrer, a temperature sensor, a cooling tube and a nitrogen gas-introducing device, and internal temperature was raised to 80° C. Subsequently, 40 g of the above-described dispersion <A1> in solid content conversion were charged, and a monomer solution in which a monomer mixture solution containing

| | |
|---|---|
| Styrene | 123 g |
| n-butylacrylate, | 45 g |
| Methacrylic acid | 20 g |
| n-octylmercaptan and | 0.5 g |
| Paraffin wax (HNP-57, produced by Nippon Seiro Co., Ltd.) | 82 g |

were dissolved at 80° C. was further added therein, and mixed and dispersed by a mechanical homogenizer (CLEARMIX, manufactured by M-Technique Co., Ltd.) having a circulation route for one hour to prepare a dispersion containing emulsified particles. Next, an initiator solution in which 5 g of potassium persulfate were dissolved in 100 g of deionized water was added into the above-described dispersion, and this system was heated at 80° C. for one hour to conduct polymerization (the second stage polymerization) reaction, whereby a dispersion <A2> in which resin particle [A2] was dispersed was obtained.

(3) The Third Stage Polymerization

An initiator solution in which 10 g of potassium persulfate were dissolved in 200 g of deionized water was added into the above-described dispersion <A2>, and a monomer mixture solution containing

| | |
|---|---|
| Styrene | 390 g |
| n-butylacrylate | 143 g |
| Methacrylic acid | 37 g |
| n-octylmercaptan | 13 g |

was dripped at a temperature of 80° C. over one hour. After dripping was completed, the system was stirred while heating for 2 hours to conduct polymerization (the third polymerization). Subsequently, the system was cooled to 28° C. to obtain resin particle dispersion <1>in which resin particle [1] composed of composite resin particles was dispersed. Resin particle [1] had a glass transition point of 49° C.

[Preparation Example of Clear Toner 1]

In a 5 liter reaction vessel equipped with a stirrer, a temperature sensor, a cooling tube and a nitrogen gas-introducing device, 450 g of resin particle dispersion <1> in solid content conversion and a surfactant solution obtained by dissolving 2 g of sodium polyoxyethylene(2)dodecyl ether sulfate in 1100 g of deionized water were charged and the liquid temperature was adjusted to 30° C. Then, 5N of sodium hydroxide were added into this solution to adjust pH at 10.

Next, an aqueous solution obtained by dissolving 60 g of magnesium chloride hexahydrate in 60 g of deionized water was added at 30° C. spending 10 minutes while stirring, and after standing for 3 minutes, temperature was started to be raised. Temperature of this system was increased to 85° C. spending 60 minutes; particle growth reaction was continued in a state where temperature was maintained at 85° C.; and particle diameters of associated particles were measured in this state, employing "Coulter Counter Multisizer 3" manufactured by Beckman Coulter Co., Ltd. When a volume-based medium diameter reached 7.4 μm, an aqueous solution obtained by dissolving 200 g of sodium chloride in 860 g of deionized water was added therein to terminate the particle growth. Further, after fusing was conducted by heating the system while stirring at a liquid temperature of 95° C. for a ripening treatment, and this process was continued until circularity of the particles reached 0.90, the liquid temperature was lowered to 30° C. Then, solid/liquid separation was conducted employing a basket type centrifugal separator (MARK III type No. 60×40, produced by Matsumoto Kikai Co. Ltd.) to form a wet cake of toner mother particles, and the wet cake was repeatedly washed with 40° C. deionized water using the basket type centrifugal separator until the filtrate reached an electrical conductivity of 5 μS/cm; subsequently transferred to "Flash Jet Dryer, produced by Seishin Enterprise Co., Ltd."; and dried until a moisture content reached 0.5% by weight to obtain clear toner particle [1]. Then, 1% by weight of hydrophobic silica (a number average primary particle diameter of 12 nm) and 0.3% by weight of hydrophobic titanium oxide (a number average primary particle diameter of 20 nm) were added into clear toner particle [1], and mixed employing "Henschel mixer" (manufactured by Mitsui Mining Co., Ltd.) to prepare clear toner (1). Clear toner (1) has a softening point of 133° C., a glass transition point of 49° C., a volume-based median diameter of 5.3 μm, and an average circularity of 0.910.

[Preparation Example of Clear Toners (2)-(5)]

Clear toners (2)-(5) having volume-based median diameters of 7.2 μm, 14.8 μm, 3.3 μm and 20.2 μm, respectively, were prepared similarly to the preparation example of clear toner (1), except that timing of adding the sodium chloride into associated particles was changed. In addition, any of the clear toners has a softening point of 133° C., a glass transition point of 49° C., and an average circularity of 0.910.

Example 1

In an image forming apparatus "bizhub C353", manufactured by Konica Minolta Business Technologies, Inc., commercially available chromatic toners (cyan toner and black toner) used for "bizhub C353" were charged, and an original image composed of three solid black patch images (a size of 20 mm×50 mm) and three solid cyan patch images (a size of 20 mm×50 mm) was formed on an image support "OK TOP-KOE+157 g/m$^2$", produced by Oji Paper Co., Ltd.

Thereafter, clear toner (1) was charged in a new image forming apparatus "bizhub C353", manufactured by Konica Minolta Business Technologies, Inc., and formed was a gloss adjusting layer constituted of a clear toner-fixed image containing gloss adjusting units densely arranged in the vertical direction and in the horizontal direction within a plane of the original image, each gloss adjusting unit having a pattern represented by FIG. 2*a*, of which a length of one side of the unit was 100 μm, whereby a gloss adjusted image was obtained. A gloss adjusting layer was formed in the same manner as above also in each of the cases when the lengths of one side of the unit were 200 μm, 300 μm, 400 μm and 500 μm.

Examples 2-7

Examples 2-7 were carried out in the same manner as in Example 1 except that the kinds of clear toners and gloss adjusting units were changed as shown in Table 1. In Example 4, a gloss adjusting unit represented by FIG. 2*b* described below was used, namely, a gloss adjusting unit in which a clear toner-unattached section was formed in a square located in the center of the gloss adjusting unit, of which one side had a length of (½) times of the length of one side of the gloss adjusting unit.

Comparative Example 1

In Comparative Example 1, a gloss adjusting layer was formed in the same manner as in Example 2 except that a gloss adjusting unit represented by FIG. 2*d* was employed instead of a gloss adjusting unit represented by FIG. 2*a*.

Evaluation of each gloss adjusted image was carried out as described below.

[Evaluation 1: Controllability of Glossiness]

The glossiness of gloss adjusted image was measured in accordance with "JIS Z8741". In addition, the glossiness was measured at an incident angle of 75°, employing "GARDENER•MICROGLOSS 75°", manufactured by Toyo Seiki Seisakusho, Ltd. For each obtained gloss adjusted image, the glossiness of one portion of each of the three solid black patch images and the three solid cyan patch images was measured. The average of the glossiness values of the six portions of each gloss adjusted image was calculated and listed in Table 1. Controllability of glossiness was evaluated by a "maximum value−minimum value" of the glossiness values observed when the length of one side of the gloss adjusting unit was changed from 100 μm to 500 μm. The results were listed in Table 1.

Each obtained gloss adjusted image was visually observed, and the transparency of each gloss adjusted image was evaluated according to the following criteria.

A: The gloss adjusting layer exhibits excellent transparency whereby the color of the original image is not spoiled.

B: The gloss adjusting layer exhibits slightly reduced transparency whereby the color of the original image is slightly spoiled, however, there is practically no problem.

C: The gloss adjusting layer exhibits reduced transparency whereby the color of the original image is spoiled.

TABLE 1

| | Clear toner No. | Particle diameter of clear toner (μm) | Gloss adjusting unit | Glossiness at each length (μm) of one side of gloss adjusting unit 100 μm | 200 μm | 300 μm | 400 μm | 500 μm | Controllable range of glossiness (maximum gloss − minimum gloss) | Ttransparency | Thickness of gloss adjusting layer (μm) |
|---|---|---|---|---|---|---|---|---|---|---|---|
| Ex. 1 | [1] | 5.3 | FIG. 2a | 43 | 53 | 68 | 76 | 80 | 37 | A | 4 |
| Ex. 2 | [2] | 7.2 | FIG. 2a | 45 | 57 | 69 | 75 | 81 | 36 | A | 5 |
| Ex. 3 | [3] | 14.8 | FIG. 2a | 42 | 51 | 63 | 71 | 76 | 34 | A | 12 |
| Ex. 4 | [2] | 7.2 | FIG. 2b | 56 | 66 | 70 | 76 | 82 | 26 | A | 5 |
| Ex. 5 | [2] | 7.2 | FIG. 2c | 56 | 60 | 68 | 74 | 81 | 25 | A | 5 |
| Ex. 6 | [4] | 3.3 | FIG. 2a | 66 | 68 | 73 | 75 | 79 | 13 | A | 2 |
| Ex. 7 | [5] | 20.2 | FIG. 2a | 38 | 42 | 44 | 55 | 59 | 21 | B | 15 |
| Comp. 1 | [2] | 7.2 | FIG. 2d | 45 | 47 | 49 | 50 | 52 | 8 | A | 5 |

As is clear from the above-described results of Examples 1-7 in the present invention, it was confirmed that glossiness could be adjusted by appropriately selecting the kind and the size of the gloss adjusting unit.

Specifically, according to Examples 1-3, by adjusting the thickness of gloss adjusting layer to 3-20 μm and the particle diameter to 5-20 μm, and selecting the gloss adjusting unit represented by FIG. 2*a*, it was confirmed that a wide gloss controllable range could be obtained, whereby the gloss of an image could be precisely adjusted.

On the contrary, according to Comparative Example 1, it was clear that the gloss controllable range was narrow when the gloss adjusting unit represented by FIG. 2*d* was selected, compared to when any of the gloss adjusting units represented by FIGS. 1*a*-1*c*.

What is claimed is:

1. A method of forming an image comprising the steps of:

forming an image on an image support to obtain an original image, and forming a gloss adjusting layer comprising a clear toner-fixed image comprising a clear toner on the original image, wherein the gloss adjusting layer comprises an aggregate of gloss adjusting units, wherein the gloss adjusting units each comprise a section where the clear toner is attached and a section where the clear toner is unattached, wherein a borderline between the section where the clear toner is attached and the section where the clear toner is unattached comprises a straight line, wherein the gloss adjusting units each has a form of a square, wherein one side of the square is 100-500 μm, wherein each of the gloss adjusting units is composed of four squares, each of the four squares being formed by dividing each of the gloss adjusting units vertically and horizontally in half, wherein the four squares are arranged to form a checkered pattern in which two of the four squares are the sections where the clear toner is attached, wherein the sections where the clear toner is attached are diagonally arranged, and wherein the step of forming the gloss adjusting layer further comprises adjusting a glossiness of the image by varying a length of the side of the gloss adjusting unit.

2. The method of claim 1, wherein the gloss adjusting layer has a thickness of 3-20 μm.

3. The method of claim 1, wherein the clear toner comprises a particle having a particle diameter of 5-15 μm.

4. The method of claim 1, wherein the longer the length of the side of the gloss adjusting unit is, the higher the glossiness is, and the shorter the length of the side of the gloss adjusting unit is, the lower the glossiness is.

5. An image forming apparatus comprising:

a device for forming a clear toner image by which an electrostatic latent image formed on an electrostatic latent image carrier is developed with a developer containing a clear toner to form the clear toner image, and a device for forming a gloss adjusting layer by which the clear toner image is transferred onto an original image and fixed to form the gloss adjusting layer, the original image being obtained by forming an image on an image support, wherein the gloss adjusting layer comprises an aggregate of gloss adjusting units, wherein the gloss adjusting units each comprise a section where the clear toner is attached and a section where the clear toner is unattached, wherein a borderline between the section where the clear toner is attached and the section where the clear toner is unattached comprises a straight line, wherein the gloss adjusting units each has a form of a square, wherein one side of the square is 100-500 μm, wherein each of the gloss adjusting units is composed of four squares, each of the four squares being formed by dividing each of the gloss adjusting units vertically and horizontally in half, wherein the four squares are arranged to form a checkered pattern in which two of the four squares are the sections where the clear toner is attached, wherein the sections where the clear toner is attached, are diagonally arranged, and wherein a glossiness of the gloss adjusting layer is adjusted by varying a length of the side of the gloss adjusting unit.

6. The image forming apparatus of claim 5, wherein the longer the length of the side of the gloss adjusting unit is, the higher the glossiness is, and the shorter the length of the side of the gloss adjusting unit is, the lower the glossiness is.

* * * * *